United States Patent [19]

Senfter

[11] Patent Number: 4,967,724

[45] Date of Patent: Nov. 6, 1990

[54] GAS PRESSURE PISTOL, PARTICULARLY SPORTS PISTOL

[75] Inventor: Emil Senfter, Lienz, Austria

[73] Assignee: Steyr-Daimler-Puch AG, Vienna, Austria

[21] Appl. No.: 316,473

[22] Filed: Feb. 27, 1989

[30] Foreign Application Priority Data

Mar. 4, 1988 [AT] Austria ..... 681/88
Jun. 27, 1988 [AT] Austria ..... 1652/88

[51] Int. Cl.[5] ..... F41B 11/00
[52] U.S. Cl. ..... 124/76; 124/74
[58] Field of Search ..... 124/73, 76, 74, 72, 124/71, 31, 70; 89/7; 42/69.01

[56] References Cited

U.S. PATENT DOCUMENTS

| | | | |
|---|---|---|---|
| 2,940,438 | 6/1960 | Merz | 124/76 |
| 3,227,148 | 1/1966 | Spack | 124/76 |
| 3,527,194 | 9/1970 | Vadas | 124/76 |
| 3,824,981 | 7/1974 | Crane et al. | 124/74 X |
| 4,004,566 | 1/1977 | Fischer | 124/76 X |
| 4,336,787 | 6/1982 | Cagnoni | 124/76 X |

FOREIGN PATENT DOCUMENTS

| | | |
|---|---|---|
| 307275 | 5/1973 | Austria . |
| 3242102 | 5/1984 | Fed. Rep. of Germany . |

OTHER PUBLICATIONS

Feinwerkbau Bedienungsanleitung–Instructions Modell 2, 1988.

*Primary Examiner*—Peter M. Cuomo
*Attorney, Agent, or Firm*—Marmorek, Guttman & Rubenstein

[57] ABSTRACT

A gas pressure pistol, particularly a sports pistol, comprises a compressed gas container, which is disposed below the barrel and which via a passage that is adapted to be closed by a valve communicates with the rear end of the barrel, also comprises a bolt, which is guided in a housing and is adapted to be retracted from the rear end of the barrel, and a trigger mechanism, which is accommodated in the housing and comprises a trigger lever, which is pivotally movable in a pull-off sense, a trigger blade carried by the trigger lever, a spring which opposes the movement of the trigger lever in the pull-off sense, a sear, which cooperates with the trigger lever, and a catch lever, which in a catching position interlocks with the sear and is adapted to retain a spring-loaded striker, which serves to actuate the valve. To permit the trigger lever and the trigger blade to be disposed as close as possible to the barrel, the valve comprises a striking pin, which extends preferably in a longitudinal rib of the housing rearwardly beyond the trigger blade toward the striker, and the trigger lever is pivoted above the striking pin slightly below the track for the bolt and is provided at its top with two legs, which are optionally disposed on opposite sides of the longitudinal rib.

3 Claims, 1 Drawing Sheet

GAS PRESSURE PISTOL, PARTICULARLY SPORTS PISTOL

BACKGROUND OF THE INVENTION

1. Field of the Invention

This invention relates to a gas pressure pistol, particularly a sports pistol, comprising a compressed gas container, which is disposed below the barrel and which via a passage that is adapted to be closed by a valve communicates with the rear end of the barrel, also comprising a bolt, which is guided in a housing and is adapted to be retracted from the rear end of the barrel, and a trigger mechanism, which is accommodated in the housing and comprises a trigger lever, which is pivotally movable in a pull-off sense, a trigger blade carried by the trigger lever, a spring which opposes the movement of the trigger lever in the pull-off sense, a sear, which cooperates whith the trigger lever, and a catch lever, which in a catching position interlocks with the sear and is adapted to retain a spring-loaded striker, which serves to actuate the valve.

2. Description of the Prior Art

Such a gas pressure pistol is already known (Fernwerkbau, Bedienungsanleitung-Instructions Modell 2). Various adjusting screws are provided in that pistol for different parts of the trigger mechanism so that the pull-off position, the trigger pull weight, and the so-called trigger stop, i.e., the pivotal movement of the trigger lever over the sear, can be changed, as is of special importance with sports pistols. The striker is movably mounted above the trigger lever and has in front of the trigger lever a depending nose, which acts on the valve. As a result, the pivot for the trigger lever is necessarily on a relatively low level.

As the round is discharged, the recoil will result in a torque that is exerted on the shooting arm and causes the axis of the barrel to depart from the target. To minimize that torque, the shooting arm should be held or supported at a short distance from the axis of the barrel. This will reduce also the canting of the shooting arm. It must be borne in mind that a large number of shots must be discharged in close succession in sports competitions and that a premature fatigue of the shooter must be avoided. The hand which holds the shooting arm must also be used to pull the trigger. If the trigger lever and the trigger blade are spaced a relatively large distance apart, as is the case in the known sports pistol because the striker moves over the trigger lever and trigger blade, it will be necessary to hold the shooting arm at a large distance below the barrel axis. On the other hand, the barrel, the hand and the underarm of the shooter should be aligned as exactly as possible when the round is discharged.

In a known device for firing flame cartridges, illuminating and signal ammunition or the like, the trigger lever is pivoted above the firing pin (AT A-307,275). But that device is no pistol in the true meaning of the word but constitutes a barrelless device, in which the trigger lever serves also as a catch lever, which retains the firing pin against spring force and bears on a stop face of the housing. As the trigger lever is moved in the pull-off direction, it is moved away from that stop surface and releases the firing pin, which then acts on the primer cap, which has been screwed to a carrier in the housing of the device. In that case it is not desired to arrange the trigger lever and the trigger blade close to the barrel because there is no barrel at all. Besides, the pivotal axis of the trigger lever could not be arranged below the firing pin because in that case the pivotal movement of the trigger lever would be blocked by the stop surface of the housing. Such a device cannot be compared at all with a sports pistol because the conditions are entirely different and aimed shots are not discharge.

SUMMARY OF THE INVENTION

It is an object of the invention so to improve the gas pressure pistol described first hereinbefore that the shooting arm can be held as close as possible to the barrel axis by the hand which also pulls the trigger.

The object set forth is accomplished in accordance with the invention in that the valve comprises a striking pin, which extends preferably in a longitudinal rib of the housing rearwardly beyond the trigger blade toward the striker, and the trigger lever is pivoted above the striking pin slightly below the track for the bolt and is provided at its top with two legs, which are optionally disposed on opposite sides of the longitudinal rib.

Because the relatively massive striker has been displaced further to the rear and only the thin striking pin extends forwardly to the valve, the trigger lever can be pivoted above that striking pin and slightly below the track for the bolt so that the distance from the trigger blade to the barrel axis is minimized. This will result in an improved holding of the pistol, which can be held more steadily and more reliably. Nevertheless the striking pin is properly guided and the trigger lever and the striking pin will not interfere with each other.

DETAILED DESCRIPTION OF THE PREFERRED EMBODIMENT

Figure 1:
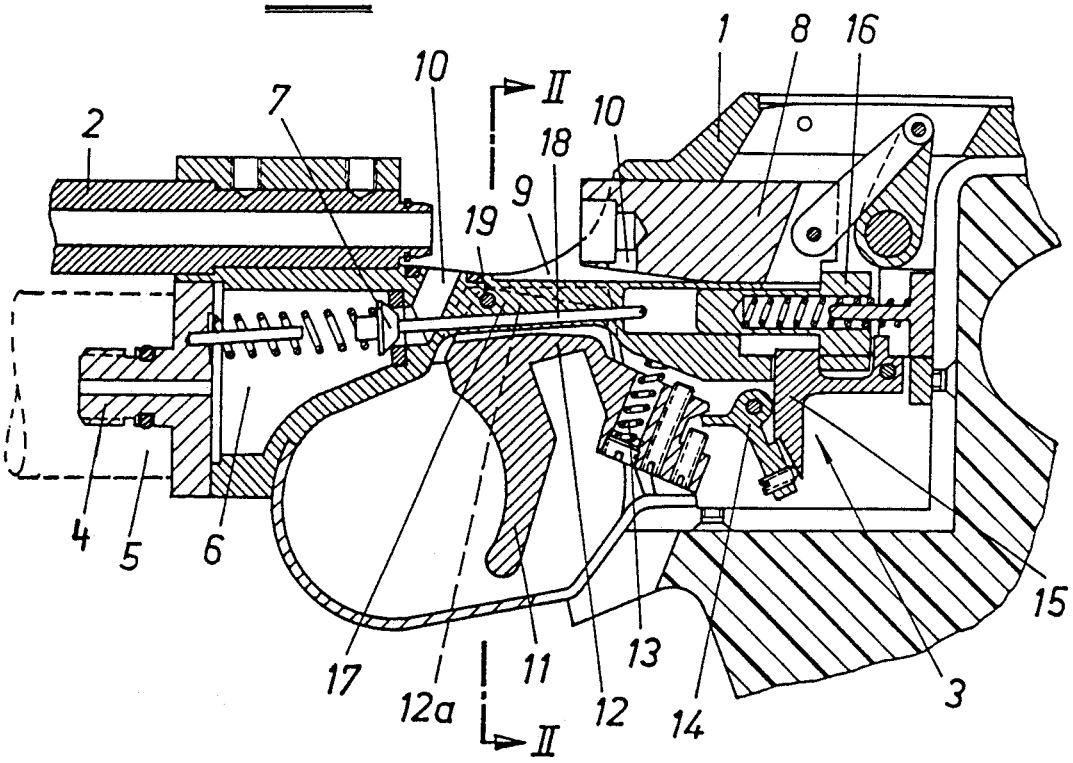
FIG. 1 is a longitudinal sectional view showing those parts of a gas pressure pistol which are essential for an understanding of the invention.
Figure 2:
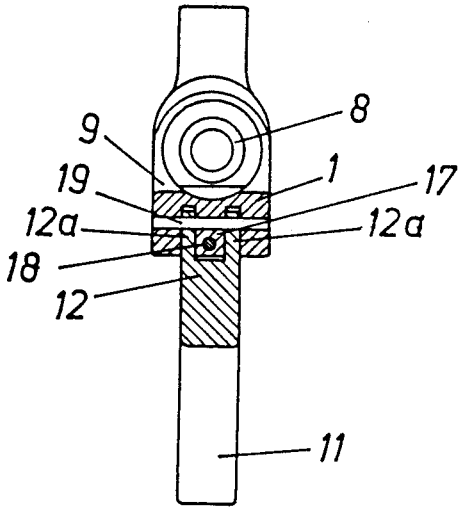
FIG. 2 is a transverse sectional view taken on line II—II in FIG. 1.

The pistol comprises a housing, which is generally designated 1, a barrel 2, which is secured in the housing 1, and a trigger mechanism 3, which is accommodated in the housing 1. A compressed gas container 5 consisting particularly of a $CO_2$ cartridge is screwed on the tubular port 4, which protrudes from the housing 1 below the barrel 4. As that container or cartridge is screwed to the tubular port 4, the value of the container or cartridge is opened so that compressed gas from the container or cartridge enters the compressed gas chamber 6, which is closed by a valve 7. FIG. 1 shows the shooting arm in the position which is assumed by the parts when the bolt 8, which is slidable in a track 9, has been pulled back from the rear end of the barrel. In that position of the parts a projectile consisting of a so-called diabolo bullet is inserted into the rear end of the barrel and the bolt 8 is subsequently advanced to close the barrel at its rear end and to establish a communication between the rear end of the barrel and the valve 7 via a passage 10.

The trigger mechanism 3 comprises a trigger level 12, which carries a trigger blade 11 and is biased by a spring 13, which opposes the movement of the trigger lever in the pull-off sense. The trigger mechanism also comprises a sear 14, which cooperates with the trigger level 12, and a catch lever 15, which interlocks with the sear 14 and which in the illustrated catching position retains the striker 16, which is biased by a spring.

It is apparent that the valve 7 is provided with a striking pin 18, which extends rearwardly in a longitudinal rib 17 of the housing 1 beyond the trigger blade 11 toward the striker 16 and that the trigger lever 12 is pivoted on the pivot 19, which is disposed above the striking pin 18 and slightly below the track 9 for the bolt 8. The trigger lever 12 terminates in two legs 12*a*, which extend on opposite sides of the longitudinal rib 17.

As the trigger blade 11 is moved in a counterclockwise sense, the sear 14 will be pivotably moved after a certain initial pivotal movement of the trigger lever 12 so that the interlock with the catch lever 15 will be released and the striker 16 can shoot forward to the striking pin 18 so that the valve 7 will be opened and compressed gas will be delivered behind the projectile which has been inserted into the barrel.

What is claimed is:

1. A gas pressure pistol comprising a housing, a barrel, which is fixed to said housing and has a rear end, a compressed gas container, which is connected to said housing and disposed below said barrel, means defining a passage through which said container communicates with said rear end of said barrel, a valve for normally closing said passage, a track provided in said housing, a bolt, which is guided by said track for a movement to and from said rear end of said barrel, a spring-loaded striker, which is disposed in said housing behind said valve and is adapted to open said valve under spring force, a trigger mechanism, which is accommodated in said housing and comprises a trigger lever, which is pivotally movable in a pull-off sense, a trigger blade carried by said trigger lever, a sear for cooperating with said trigger lever, a spring, which opposes the movement of said trigger lever in said pull-off sense and against said sear, and a catch lever, which is movable to a catching position and in said catching position is arranged to interlock with said sear and adapted to retain said spring-loaded striker, a striking pin, which extends rearwardly over said trigger blade toward said striker and is operable by said striker to open said valve, and a pivot point on said housing located over said striking pin and closely below said track, said trigger lever being pivoted on said pivot point, said trigger lever being formed with two legs at its top.

2. The pistol set forth in claim 1, wherein said housing has a longitudinal rib and said striking pin is guided in said longitudinal rib.

3. The pistol set forth in claim 2, wherein said legs extend on opposite sides of said longitudinal rib.

* * * * *